United States Patent [19]

Lupkas et al.

[11] 3,977,320

[45] Aug. 31, 1976

[54] ELECTRICALLY CONTROLLED POSTAGE METER

[75] Inventors: Raymond R. Lupkas, Trumbull; Keith E. Schubert, Rowayton, both of Conn.

[73] Assignee: Pitney-Bowes, Inc., Stamford, Conn.

[22] Filed: Mar. 18, 1975

[21] Appl. No.: 559,491

[52] U.S. Cl. ..... 101/110; 178/33 R; 197/55; 335/268

[51] Int. Cl.[2] ..... B41J 7/48; B41J 7/54

[58] Field of Search ..... 178/27, 33 R, 34; 335/268; 101/110, 93.22, 93.38–93.42; 197/12, 18, 49–55

[56] References Cited

UNITED STATES PATENTS

| | | | |
|---|---|---|---|
| 2,867,168 | 1/1959 | Roth | 101/110 X |
| 3,025,510 | 3/1962 | Lovejoy | 178/33 R |
| 3,414,854 | 12/1968 | Saylor | 178/34 |
| 3,430,120 | 2/1969 | Kataka et al. | 335/267 |
| 3,465,329 | 9/1969 | Abel | 178/34 |
| 3,495,240 | 2/1970 | Saylor | 335/268 |
| 3,616,888 | 11/1971 | Kawana et al. | 178/34 |
| 3,709,144 | 1/1973 | Sims | 101/45 |
| 3,743,073 | 7/1973 | Perez | 178/34 |

*Primary Examiner*—Clifford D. Crowder
*Assistant Examiner*—William Pieprz
*Attorney, Agent, or Firm*—William D. Soltow, Jr.; Albert W. Scribner; Robert S. Salzman

[57] ABSTRACT

An electromechanical setting mechanism is disclosed, which uses a plurality of solenoid banks to set each print wheel of a postage printing drum. Each bank features two pairs of solenoids which are mounted upon a movable frame. One pair of the two pairs of solenoids cause the frame to move with respect to the meter housing. The moving frame in turn, positions a setting linkage which sets a postage value for a print wheel. The other pair of solenoids acts directly upon this setting linkage so as to also set a postage value for the print wheel. Each solenoid is actuated by coded electrical signals, and is offset from the center of a setting link a differing amount, to provide differing resultant settings. The actuation of any or some of the solenoids, will provide any given print wheel position from zero through nine.

9 Claims, 4 Drawing Figures

ELECTRICALLY CONTROLLED POSTAGE METER

This invention relates to postage meters, and more particularly to an electromechanical setting mechanism for setting the print wheels of a postage meter printing drum.

BACKGROUND OF THE INVENTION

Heretofore, there have been several devices using a plurality of solenoids for positioning indicator or printing wheels. Each solenoid is of a different stroke, so that actuating one or a combination of these solenoids will provide a setting from zero through nine. Such devices may be seen with reference to the following patents:

SAYLOR; U.S. Pat. No. 3,414,854; issued: 12/3/68
KOTAKA et al; U.S. Pat. No. 3,430,120; issued: 2/25/69
COX et al; U.S. Pat. No. 3,491,319; issued: 1/20/70
SAYLOR: U.S. Pat. No. 3,495,240; issued: 2/10/70
COX et al; 3,543,204; issued: 11/24/70

The present invention is concerned with using some of the teachings expressed in the foregoing devices to operate and control a postage meter. It is believed that the inventive setting mechanism is the first of its kind in the postage meter art.

SUMMARY OF THE INVENTION

The invention is for an electromechanical setting mechanism for a postage meter. A plurality of solenoid banks are provided to set each respective print wheel of a postage print drum.

Each bank features two pairs of solenoids mounted upon a unique "floating" movable frame support. One pair of the two pairs of solenoids causes the frame to move with respect to the meter housing. The moving frame in turn, positions a setting linkage which sets a postage value for a print wheel. The other pair of solenoids acts directly upon this setting linkage to also set a postage value for the respective print wheel.

Each solenoid is actuated by coded electrical signals, and each solenoid in a bank is offset from the center of a setting link a different amount to provide a different resultant stroke. In this way a respective print wheel can be set for any postage value from zero to nine.

The setting mechanism of the invention will usually employ three or four banks, although more banks can be accommodated if desired. A change of meter design is easily accomplished using the invention, because each bank is compact to easily fit within a meter housing. Also each setting bank is independent of the others (modular), so that the addition or subtraction of a bank will present a minimum of meter modifications.

Because each bank is of modular construction, an ease of maintenance is provided. In the event that any part of a setting bank should fail, the whole bank can be easily removed and replaced without disturbing the rest of the meter.

The inventive setting mechanism and meter construction can provide a self-monitoring capability not found in standard mechanical meters; i.e., each bank can be electrically monitored to determine if it is properly set to a desired postage value.

The inventive meter design provides a setting mechanism which has a minimum of working parts, is compact, reliable, and easy to maintain.

It is an object of the present invention to provide an improved postage meter, and postage meter setting mechanism;

It is another object of this invention to provide a postage setting mechanism which can be controlled and operated using coded signals.

It is a further object of the invention to provide a postage setting mechanism for a postage meter having a modular construction.

These and other objects of the invention will be better understood and will become more apparent with reference to the following detailed description taken in conjunction with the attached drawings, in which.

Generally speaking, the invention is for an electrically controlled postage meter having an electromechanical setting means. The setting means comprises a plurality of setting banks, one bank for each print wheel in the postage meter printing drum. Each bank has a plurality of solenoids substantially arranged within a common plane with respect to each other. The solenoids are mounted upon a movable frame, such that as certain of said solenoids are actuated, the frame is caused to move. The solenoids are selectively actuated by electrically coded signals to provide any one of a multiple of print wheel postage value positions.

Figure 1:
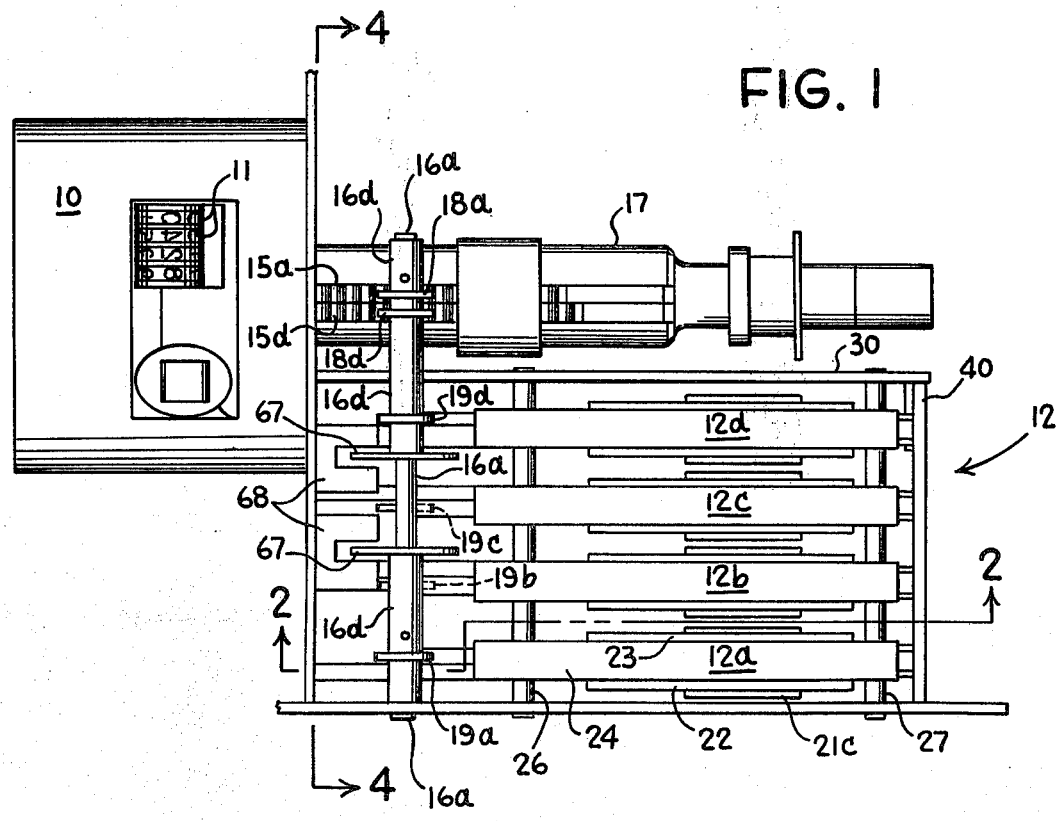
FIG. 1 is a plan view of a postage meter printing and setting mechanism of this invention.
Figure 2:
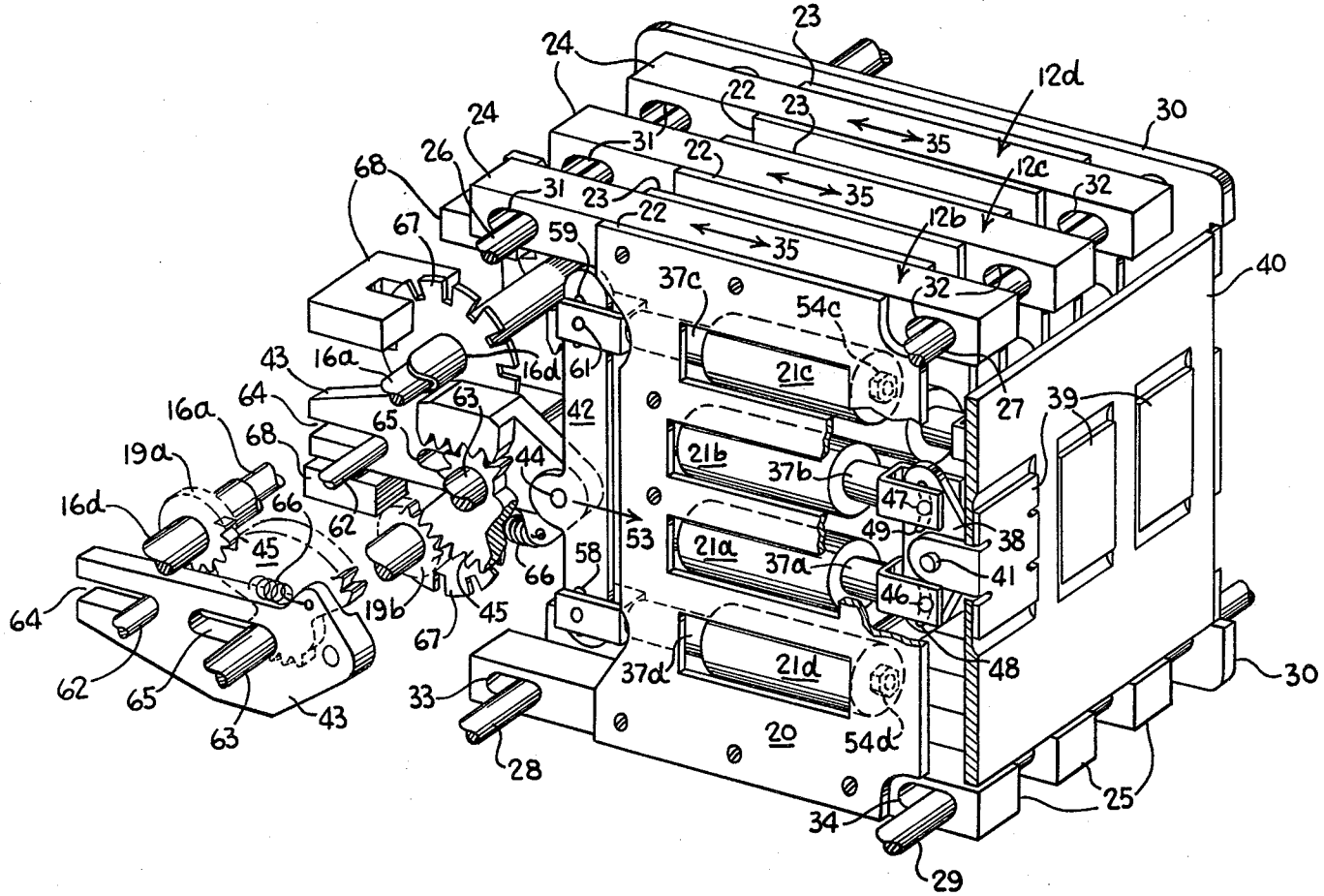
FIG. 2 is a perspective view of the inventive setting mechanism of FIG. 1, taken along lines 2—2.
Figure 4:
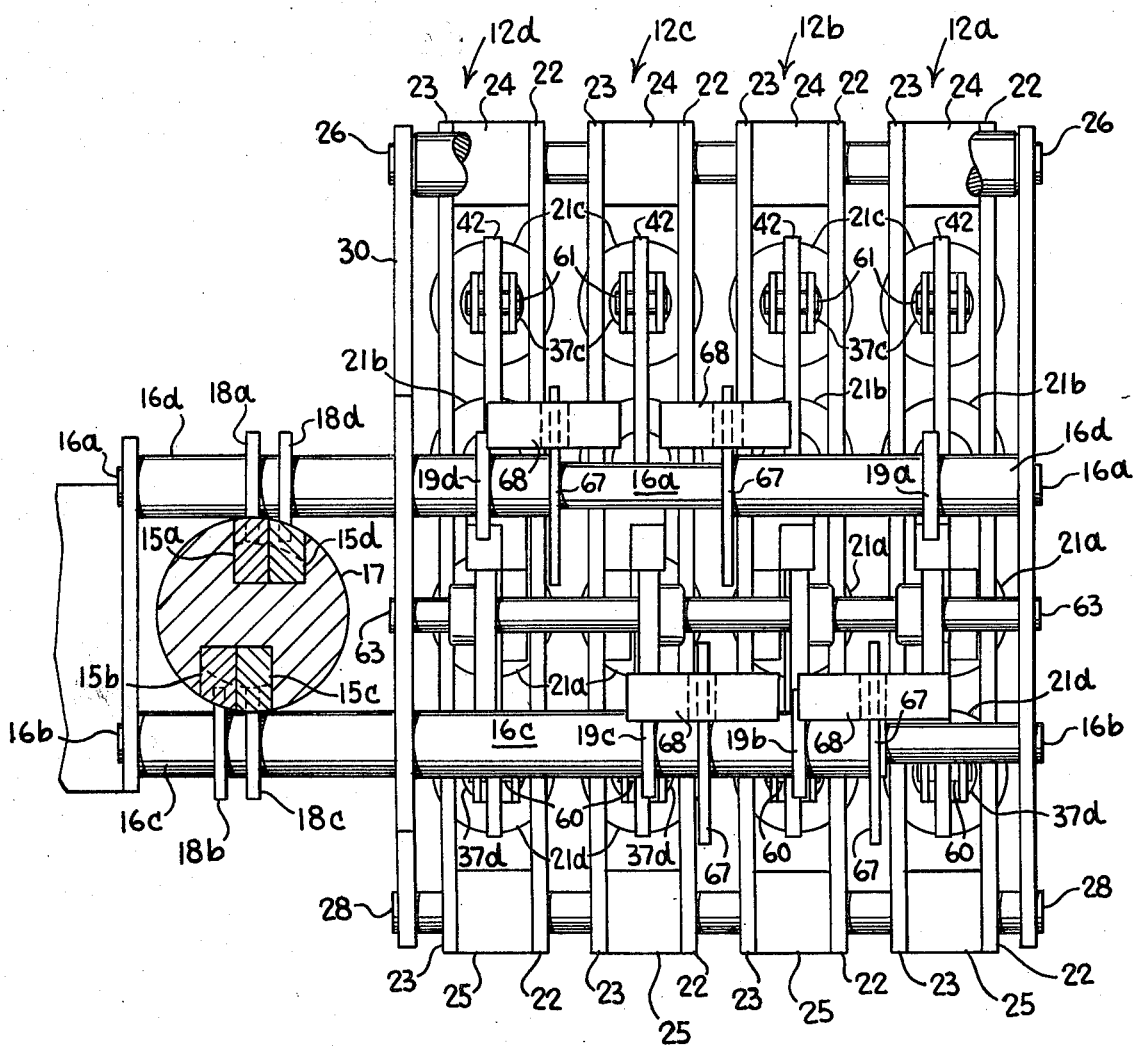
FIG. 4 is a frontal view of the inventive postage meter printing and setting mechanism of FIG. 1 taken along lines 4—4.

Now referring to FIG. 1, a plan view of the inventive postage meter setting and printing mechanism is shown. The printing of postage is accomplished by a printing drum 10, which contains a plurality of printing wheels 11 (typical). In the particular meter configuration to be described, there is depicted four print banks, i.e., there are four print wheels 11 in drum 10 for providing digits, tens, dollars and tens of dollars, for a maximum of $99.99 of postage. Each print wheel 11 is set to a postage value from zero through nine. The mechanism for accomplishing the setting of these wheels is generally depicted by arrow 12. This setting mechanism 12 has four setting banks **12*a*, 12*b*, 12*c* and 12*d*, respectively (FIGS. 1, 2 and 4). Each bank respectively controls and sets one of the four print wheels 11. The setting banks are operatively connected to the print wheels 11 by means of two sets of print wheel racks 15*a*; 15*d* and 15*b*; 15*c*, upper and lower nested cross-over shafts 16*a*; 16*d* and 16*b*; 16*c* respectively. The upper outer shaft 16*d* has an interior shaft 16*a* nested therein (FIG. 4). The lower outer shaft 16*c* has an interior shaft 16*b* nested therein (FIG. 4). Each of the shafts 16*a*, 16*b*, 16*c* and 16*d*, respectively support a pair of spur gears 18*a*, 19*a*; 18*b*, 19*b*; 18*c*, 19*c*; and 18*d*, 19*d*; respectively. Spur gears 18*a*, 18*b*, 18*c* and 18*d* are in contact with, and respectively control, the print wheel racks 15*a*, 15*b*, 15*c* and 15*d*, respectively. Spur gears 19*a*, 19*b*, 19*c* and 19*d*, are respectively in contact with setting banks 12*a*, 12*b*, 12*c*, 12*d*, such that each bank will control a corresponding print wheel rack. For example, bank 12*a* will turn spur gear 19*a*, through a given rotation, which in turn will turn shaft 16*a*. The spur gear 18*a* which is fixed to the other end of shaft 16***a*, will then turn a like amount as that of spur gear 19*a*. Rack 15*a* will then move in response to the rotation of spur gear 18*a*. Racks 15*b*, 15*c* and 15*d*, respectively are similarly actuated via spur gears 19*b*, 19*c* and 19*d*.

Each setting bank 12*a*, 12*b*, 12*c* and 12*d*, respectively comprises a hollow frame 20 containing four solenoids 21*a*, 21*b*, 21*c* and 21*d*, as shown in FIG. 2. Each frame 20 is constructed of two boards 22 and 23, which are affixed to and separated by upper and lower beams 24 and 25, respectively. The beams 24 and 25 are supported by means of upper shafts 26 and 27, respectively and lower shafts 28 and 29, respectively. The shafts 26, 27, 28 and 29 are anchored to the postage meter frame 30. The frames 20 are all permitted to move with respect to the postage meter frame 30, because of respective slots 31, 32, 33 and 34, which are cut into each of the beams 24 and 25, respectively. These slots allow respective beams 24 and 25, and consequently each frame 20, to move in a reciprocal direction as depicted by arrows 35.

The solenoids 21*a*, 21*b*, 21*c* and 21*d* of each frame 20 are of greater diameter than the spacing between respective boards 22 and 23, and project through boards 22 and 23 via slots 36*a*, 36*b*, 36*c* and 36*d*, respectively. The solenoid's overhang provides the means of anchoring the solenoids into each frame 20.

The inner pair of solenoids 21*a* and 21*b* of each frame have their respective shafts 37*a* and 37*b* movably affixed to a pivotable link 38. The link 38 pivots about shaft 41, which is connected across the U-shaped bracket 39. Bracket 39 is anchored to the postage meter wall member 40.

The outer pair of solenoids 21*c* and 21*d* of each frame have their respective shafts 37*c* and 37*d* movably affixed to a pivotable link 42. Link 42 is pivotably connected to rack member 43 via pin 44. Rack member 43 engages with a butterfly pinion gear 45. Butterfly pinion gear 45, in turn engages with spur gear 19 (*a,b,c* or *d*, as the case may be).

Figure 3:
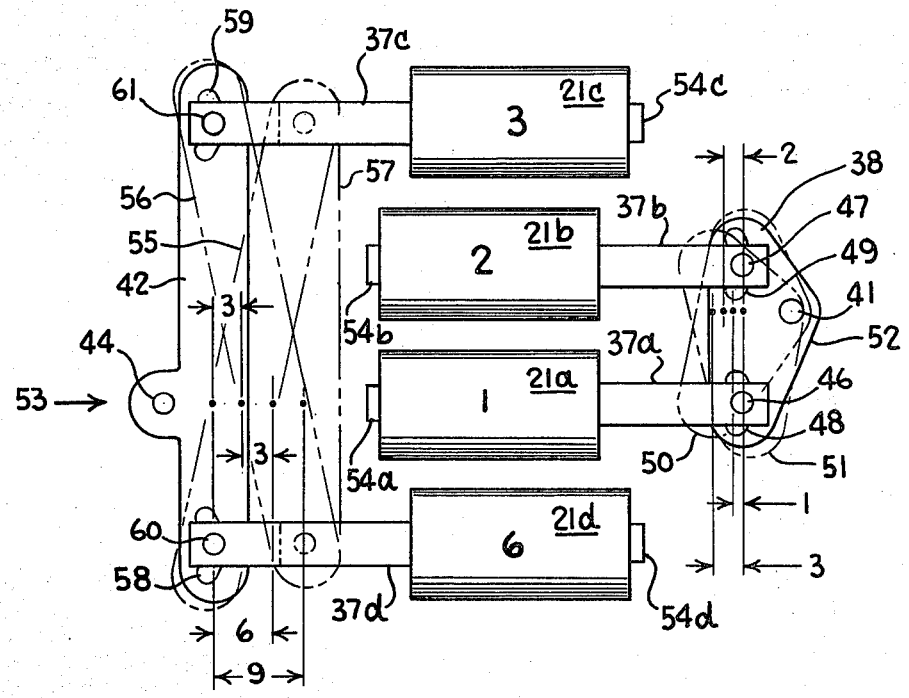
FIG. 3 is a schematic diagram illustrating the principal of operation of each setting bank of the setting mechanism of FIG. 2.

Now referring to FIG. 3, a schematic diagram illustrates the principal of operation of each setting bank 12*a*–12*d*. Solenoid pairs 21*a*, 21*b;* and 21*c*, 21*d;* of each bank have similar strokes with respect to each other. These solenoid pairs each act at different distances from pivots 41 and 44, respectively. For example, solenoid 21*a* has twice the moment arm of solenoid 21*b* about pin 41. Similarly, solenoid 21*c* has twice the moment arm of solenoid 21*d* about pin 44. These pivot pin offsets provide a differing resultant stroke for each solenoid actuation, such that any one of several resultant strokes can be obtained about the pivot points.

The inner pair of solenoids 21*a* and 21*b* have their respective shafts 37*a* and 37*b* connected to pivot link 38 via connecting pins 46 and 47. The link 38 can assume any one of three positions depending on which of the solenoids 21*a* and 21*b* are actuated. If solenoid 21*a* is actuated, link 38 will assume position 50 shown in phantom. If solenoid 21*b* is actuated, link 38 will assume position 51 shown in phantom, and if both 21*a* and 21*b* solenoids are actuated, the link will have the position shown by the solid line 52. The link 38 is free to pivot about pin 41, since each of the connecting pins 46 and 47, are respectively movable within arcuate slots 48 and 49.

It will be seen that when either or both of the solenoids 21*a* and 21*b* are actuated, link 42 is caused to move to the right as shown by arrow 53. This is so because link 38 is not free to move laterally, it being anchored by pin 41 to wall bracket 39 as illustrated in FIG. 2. Therefore, when the solenoids actuate, their motion is transmitted to the movable frame 20 (FIG. 2). The frame 20 is caused to move to the right. The solenoid shafts 37*c* and 37*d* of solenoids 21*c* and 21*d*, respectively, are anchored against pulling out of these solenoids by means of bolts 54*c* and 54*d*, respectively. This causes the movement of frame 20 to be transmitted to link 42. Link 42 will, therefore move to the right as depicted by arrow 53.

The actuation of solenoid 21*a* will cause pivot pin 44 to be displaced one unit length; solenoid 21*b* will cause a pivot pin 44 displacement of two unit lengths; and both solenoids 21*a* and 21*b* will cause the pivot pin 44 to have a displacement of three unit lengths.

When either or both outer solenoids 21*c* and 21*d* are actuated, they act directly upon pivot pin 44 of link 42. Solenoid 21*c* will provide this pin with a three unit length displacement, and solenoid 21*d* will provide a six unit length displacement. Both of these solenoids in combination will produce a nine unit length displacement for pivot pin 44 as illustrated.

Solenoid shafts 37*a* and 37*b* are similarly anchored against pulling out of solenoids 21*a* and 21*b*, respectively by means of bolts 54*a* and 54*b* as shown. This is required, because the actuation of solenoids 21*c* and 21*d* will cause a reactive force on frame 20 tending to pull shafts 37*a* and 37*b* from their respective solenoids.

When solenoid 21*c* is caused to actuate, link 42 will be caused to pivot to position 55 shown in phantom, and pin 44 will be moved a three unit length to the right (arrow 53).

When solenoid 21*d* actuates, link 42 will pivot to position 56 shown in phantom, and pin 44 will move a six unit length in direction 53.

When both solenoids 21*c* and 21*d* actuate, the link 42 will be displaced to position 57 shown in phantom, and pin 44 will move a nine unit length in direction 53.

Link 42 is able to pivot to positions 55 and 56 due to slots 58 and 59. Slots 58 and 59, respectively allow link 42 to angularly orient itself about the solenoid shaft connecting pins 60 and 61 as shown.

The actuation of certain of the solenoids 21*a*, 21*b*, 21*c* and 21*d*, respectively, will provide any unit length displacements of pin 44 of link 42 from one through nine, as illustrated in the following table:

| ACTUATED SOLENOIDS | UNIT LENGTH DISPLACEMENT |
|---|---|
| 21a | 1 |
| 21b | 2 |
| 21a;21b | 3 |
| 21a;21c | 4 |
| 21b;21c | 5 |
| 21d | 6 |
| 21a;21d | 7 |
| 21b;21d | 8 |
| 21c;21d | 9 |

Referring again to FIG. 2, it will be seen that as pin 44 is displaced (arrow 53), the rack member 43 causes the butterfly pinion gear 45 to rotate. This in turn results in rotating a particular spur gear 19 (*a,b,c*, or *d*, depending on the solenoid bank being actuated).

Racks 43 are supported for lateral movement by shafts 62 and 63, respectively. Slots 64 and 65, respectively allow the rack 43 to move with respect to supporting shafts 62 and 63.

As will be noted, racks 43 are alternately reversed for each succeeding bank, so as to accommodate upper and lower shafted spur gears 19.

A spring 66 is connected between each rack and the postage meter frame (not shown), so as to provide a return of the rack to an initial rest position after deactuation of the solenoid bank.

One of the advantages of an electrically actuated postage meter is that each setting bank may be monitored. As will be noted, upper and lower setting shafts 16*a*, 16*b*, 16*c* and 16*d* each respectively support a slotted disc 67. Monitoring wells 68 containing a photodetector (LED nad phototransistor) respectively monitor the position of each cross-over shaft, by detecting the number of slots (or teeth) of discs 67, which cut across the detection light path. In this way, each setting bank can be monitored to determine if they have in fact set each print wheel to the desired setting.

The solenoids in each bank 12*a*–12*d* are individually actuated by coded electrical signals consistent with the teachings in the aforementioned SAYLOR and COX et al patents.

Many modifications and changes in the invention as presented will naturally occur to the skilled practitioner in this art. All obvious changes are deemed to fall within the scope and purview of the invention as represented by the appended claims.

What is claimed is:

1. In an electrically controlled postage meter having a printing drum containing a plurality of print wheels each of which provide one digit of a multi-digit postage value, a print wheel setting rack operatively connected to said print drum for individually positioning each print wheel to a postage value position, and electromechanical setting means operatively connected to said print wheel setting rack for moving said print wheel setting rack for positioning said print wheels, an electromechanical setting means comprising: a plurality of modularized setting banks, one bank for each print wheel, each bank having a first and a second set of solenoids substantially arranged within a common plane with respect to each other, the first and second set of solenoids in each bank being movably carried by a movable frame module operatively connected to said print wheel setting rack, such that when said first set of solenoids is actuated said frame module and said first and second set of solenoids are caused to move, and when said second set of solenoids is actuated said print wheel setting rack is caused to move while said frame module is caused to remain stationary said first and second set of solenoids being selectively actuated by electrically coded signals to provide any one of a multiple of print wheel postage value positions.

2. The electrically controlled postage meter of claim 1, wherein said first and second sets of solenoids in each modularized bank are arranged and supported within apertures in said frame module each said frame module being which is substantially rectangular in shape.

3. The electrically controlled postage meter of claim 1, wherein said electromechanical setting means is connected to said print wheel setting rack by means of at least one cross-over shaft, said cross-over shaft having at least one pair of spur gears, each spur gear of said pair mounted for rotation upon opposite ends of the cross-over shaft, one spur gear of said pair being in engagement with said print wheel setting rack, and the other spur gear of said pair being in engagement with the electromechanical setting means.

4. The electrically controlled postage meter of claim 3, wherein each bank of the electromechanical setting means contains four solenoids, each solenoid having a movable shaft which, upon actuation, causes a different resultant stroke.

5. The electrically controlled postage meter of claim 4, comprising a meter support for supporting the respective solenoid frames for movement, the frame of each bank being operatively mounted to said meter support by a first pivotable link, a second pivotable link being mounted to each respective frame on an opposite end of the frame.

6. The electrically controlled postage meter of claim 5, further comprising a rack and pinion mechanism for each respective bank connected between said respective second pivotable link and one of said rotatively mounted spur gears of said cross-over shaft.

7. The electrically controlled postage meter of claim 1, wherein each of said first and second sets of solenoids are composed of a pair of solenoids, wherein said first set of solenoids, upon actuation, pull in an opposite direction to the pull of the second set of solenoids.

8. The electrically controlled postage meter of claim 7, comprising a meter support for supporting the respective solenoid frames for movement, the frames of each bank being operatively mounted to said meter support by a first link connected to said first pair of solenoids, a second movable link being mounted to each respective frame by means of the second pair of said solenoids on an opposite end of the frame.

9. The electrically controlled postage meter of claim 8, further comprising a rack and pinion mechanism for each respective bank connected to said respective second movable link on one end and a spur gear rotatively mounted to a cross-over shaft connected to said rack and pinion on another end thereof.

* * * * *